US008540831B1

(12) United States Patent
Cole

(10) Patent No.: US 8,540,831 B1
(45) Date of Patent: Sep. 24, 2013

(54) METHOD OF MANUFACTURING A CELL TAG

(75) Inventor: Michael E. Cole, St. Louis, MO (US)

(73) Assignee: FirstSpear, LLC, Fenton, MO (US)

( * ) Notice: Subject to any disclaimer, the term of this patent is extended or adjusted under 35 U.S.C. 154(b) by 46 days.

(21) Appl. No.: 13/416,479

(22) Filed: Mar. 9, 2012

(51) Int. Cl.
*B44F 1/00* (2006.01)

(52) U.S. Cl.
USPC ..... 156/67

(58) Field of Classification Search
USPC ..... 156/67, 66, 272.8, 250, 256, 263, 156/297, 299
See application file for complete search history.

(56) References Cited

U.S. PATENT DOCUMENTS 4,936,606 A * 6/1990 Moss ..... 283/70

* cited by examiner

*Primary Examiner* — Daniel McNally
(74) *Attorney, Agent, or Firm* — Matthews Edwards LLC

(57) ABSTRACT

A method of manufacturing a cell tag incorporating a call sign visible under low light and dark conditions, includes steps of providing a first sheet having peripheral edge portions defining at least one aperture comprising all or part of one or more symbols or characters of the call sign, providing a second sheet having a photoluminescence material or a thermal reflective material, and fixedly attaching the first sheet to the second sheet using a non-heat activated adhesive closely about the peripheral edge portions. The second sheet can have peripheral edge portions defining the at least one aperture therethrough marginally smaller than the aperture or apertures through the first sheet, to be visible through the aperture or apertures of the first sheet, and a third sheet can be attached to be visible through the aperture or apertures of the second sheet, and can include a photoluminescence or thermal reflective material.

17 Claims, 4 Drawing Sheets

METHOD OF MANUFACTURING A CELL TAG

TECHNICAL FIELD

The present invention relates to a method of manufacturing a cell tag, and more particularly, which reduces or eliminates the need for stitching so as to reduce labor required and which provides a strong bond at edges of symbols and characters of a call sign of the cell tag, to increase integrity and readability of the call sign.

BACKGROUND ART

Cell tags are carried at visible locations on the clothing or gear of military and tactical personnel, for identification purposes. Modern cell tags utilize materials that are luminescent and heat reflective so as to be visible under low light and darkness conditions. Known cell tags typically include a call sign comprising one or more identifying symbols and/or characters for identifying the wearer as friend and foe. Representative symbols can include but are not limited to, stars, hyphens, triangles, etc.; and representative characters can include, but are not limited to, alphanumeric or typographical characters such as numbers and letters, e.g., 0-9 and A-Z.

In combat and tactical environments, soldiers and law enforcement personnel often depend on the ability to recognize each other, including to account for the location of individual members of a unit or team, and to distinguish friend from foe. Under these conditions, misidentification can be dangerous, including so as to result in serious injury and death. Distances at which identifications are made can be up to several tens or even hundreds of meters or yards, and identification can be impeded by numerous factors, including, but not limited to, relative movement between the parties, e.g., one traveling in a vehicle, low light, darkness, dusty, foggy, or rainy conditions.

Some known cell tags are of a stitched or sewn together laminated construction, and include call signs having luminescent and/or infrared reflective symbols or characters displayed through apertures in the outer layer, the surrounding edge portions of which are stitched or sewn, which makes the cell tags labor intensive to make. Also, the stitching can fail or be damaged under severe usage conditions, e.g., be torn or lost, such that symbols and characters can be difficult or impossible to read correctly, which can result in difficult or mis-identification.

It is also known to laminate cell tags using heat activated adhesives between the layers, but it has been found that this can result in damage to luminescence materials used for low light and dark conditions.

Thus, what is sought is a manner of manufacturing a cell tag incorporating a call sign requiring less labor, which cell tag will be less susceptible to damage, and possible resultant difficulty and mis-identification in use, so as to overcome one or more of the shortcomings and limitations set forth above.

SUMMARY OF THE INVENTION

What is disclosed is a method of manufacturing a cell tag incorporating a call sign using less labor, and which is less susceptible to damage, and possible resultant difficulty and mis-identification in use, so as to overcome one or more of the shortcomings and limitations set forth above.

According to a preferred aspect of the invention, a method of manufacturing a cell tag having a call sign visible under low light and dark conditions, requires steps of:

providing a first sheet having a front surface, a back surface, and peripheral edge portions defining at least one aperture of a predetermined size through the first sheet comprising all or part of one or more symbols or characters of the call sign;

providing a second sheet having a front surface comprising one of a photoluminescence material and a thermal reflective material; and fixedly attaching the back surface of the first sheet to the front surface of the second sheet using only an adhesive or adhesives selected from a group consisting of a contact adhesive, a pressure sensitive adhesive, and a reactive adhesive, closely about at least a substantial portion of the peripheral edge portions.

According to another preferred aspect of the invention, the second sheet includes peripheral edge portions defining at least one aperture therethrough marginally smaller than the size of the aperture or apertures through the first sheet and positioned and oriented so as to be visible within the aperture or apertures of the first sheet when the back surface of the first sheet is fixedly attached to the front surface of the second sheet. The method additionally includes fixedly attaching a third sheet to a back surface of the second sheet such that a front surface of the third sheet will be visible through the aperture or apertures of the second sheet, the front surface of the third sheet comprising another of the photoluminescence material and the thermal reflective material.

As an attendant advantage of the invention, the peripheral edges extending about and defining the respective symbol or symbols and/or character or characters of the call sign of the cell tag are securely attached to the underlying sheet, so as to be less susceptible to being torn therefrom during hard use in environments such as combat, tactical operations and the like, where visibility and identification to friendly forces is important.

Further, it has been found that at least some photoluminescence materials used in cell tags are susceptible to damage when exposed to temperatures above those typically required for setting heat activated adhesives, which temperatures are typically about 180 degrees F. Thus, when attaching at least the sheet including the photoluminescence materials, temperatures should not exceed that heat activation temperature, e.g., 180 degrees F. Here, it should be noted that this temperature will be a function of the heat sensitivity of the photoluminescence material used, which will likely be different for different materials, and thus the value given should be understood to be provided for the purposes of example only.

According to another preferred aspect of the invention, the thermal reflective material will comprise a material that reflects radiation within the infrared range, which is nominally wavelengths from the edge of visible red light at 0.74 micrometers (μm), and extending conventionally to 300 μm. A non-limiting exemplary suitable material can be those available that meet one or more U.S. military specifications, commercially referred to by the term "glint squares", and can include the adhesive layer on the back surface thereof, e.g., with a peel off covering. According to another preferred aspect of the invention, the luminescence material can be, as a non-limiting example, those available that meet MIL-3891B Spec., and have a glow in the dark life of 10 to 24 hours after exposure to light for 10 minutes or so.

According to still another preferred aspect of the invention, the backmost surface of the cell tag will comprise or be covered with elements of one side of a hook and loop fastening system, most preferably the hook elements, for releasable attachment to the other elements of the fastening system, e.g., the pile loop side.

As still another preferred aspect of the invention, the abutting surfaces of the sheets of the cell tag will be adhered together. As an additional step, the outermost peripheral edge portions extending about and bounding the cell tag will be reinforced, such as by stitching, to further strengthen the tag.

DETAILED DESCRIPTION OF THE INVENTION

Figure 1:
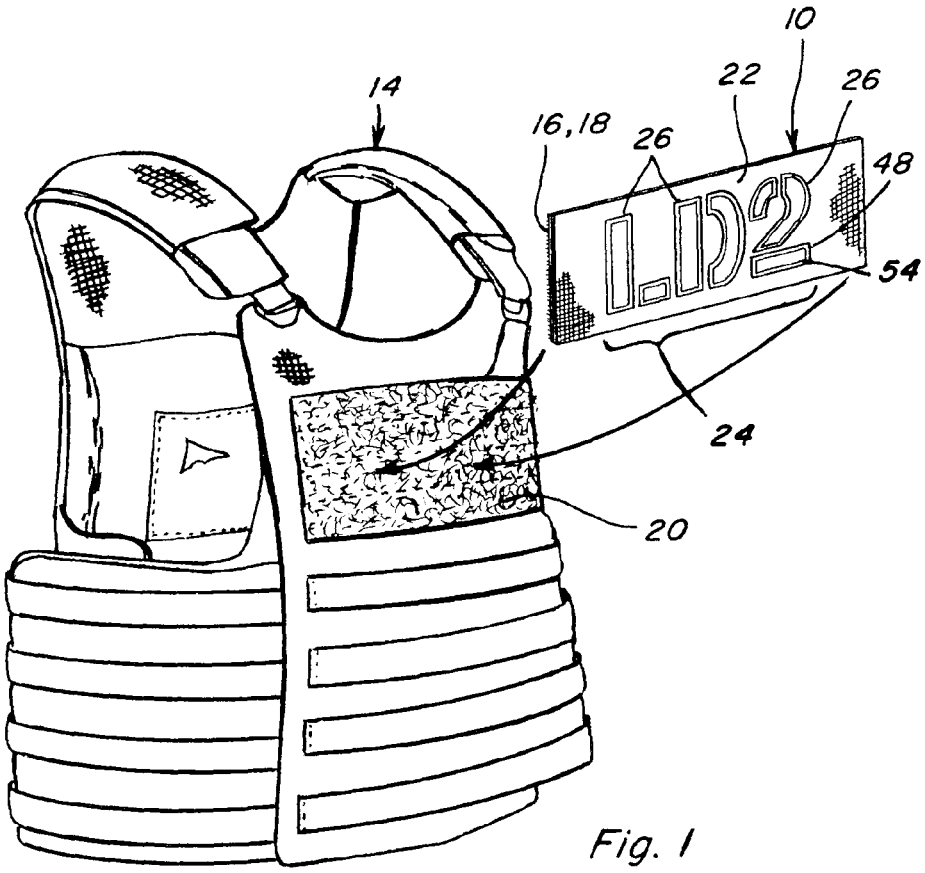
FIG. 1 is a perspective view of cell tag manufactured according to the invention, illustrating one manner of attachment to a representative garment via a hook and loop fastening system.
Figure 2:
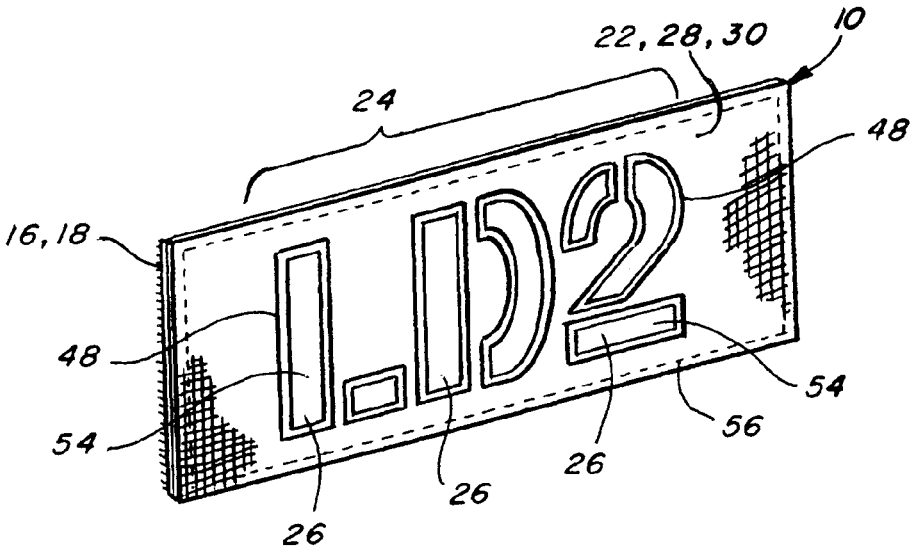
FIG. 2 is an enlarged perspective view of the cell tag of FIG. 1.

Referring now to the drawings, in FIGS. 1 through 6, two representative embodiments of a cell tag, denoted by numerals 10 and 12, respectively, are shown. In FIG. 1, cell tag 10 is shown being attached to a garment 14 which is a protective vest for wear by military and law enforcement personnel. For this purpose, cell tag 10 (and cell tag 12) has a back surface 16 comprising hooks of a hook and loop fastening system of well known construction. Hooks 18 are releasably securable in the well known manner to a pile fabric surface 20 comprising pile loops of the fastening system. Here, cell tag 10 has a generally flat, rectangular overall shape, but it should be noted that, alternatively, it can have a wide variety of shapes, and therefore is not limited to the rectangular shape shown.

Cell tag 10 has a front surface 22 that includes a call sign 24, which is intended to provide a visual identifier of the wearer of a garment to which cell tag 10 is attached, such as garment 14 illustrated. In this regard, call sign 24 will typically comprise a series or code of symbols and/or characters, denoted individually by the numerals 26, which can be for instance, selected shapes, such as triangles, dashes, etc., and/or alphanumerical characters such as Arabic numerals 0-9 and English alphabetical characters A-Z, Cyrillic letters, Greek letters, Hebrew letters, as well as others.

It will be desirable for call sign 24 to be visible under a wide variety of conditions, including daylight, cloudy, dusty, rainy, and particularly, low light and dark conditions. To facilitate visibility and identification particularly under ambient low light and dark conditions, the symbols and/or characters, herein sometimes referred to as just symbols or characters, are desirably luminescent. To facilitate visibility and identification under infrared light conditions, the symbols and/or characters are desirably infrared reflective. If the user is attired in camouflage, it will desirable for the cell tag to have an overall camouflage look, while still being usable for identification purposes.

To provide the above desired characteristics, cell tag 10 is manufactured using multiple sheets, each having one of the desired characteristics, laminated together. A first sheet 28 will be the front facing or outer portion of cell tag 10 and has a front surface 30 and a back surface 32. First sheet 28 is preferably of a suitable material such as a woven nylon, and can be of any desired color, and/or include a camouflage or other pattern on front surface 30 if desired. First sheet 28 has a plurality of peripheral edge portions 34, which can be laser or otherwise suitably cut through the material of that sheet, defining and bounding apertures 36 through first sheet 28. An attendant advantage of laser cutting is that it fuses the endmost portions of the edge portions directly adjacent to the aperture so as to limit or eliminate unraveling and fraying that could impede identification.

Each of the apertures 36 has a shape of all or a portion of at least one symbol and/or character of a predetermined first size comprising all or a portion of call sign 24. Here, as a non-limiting example, apertures 36 form the characters "L", "D" and "2" composing a call sign "LD2". A representative width dimension of the first size is denoted by the letter "X" in FIG. 3.

Figure 3:
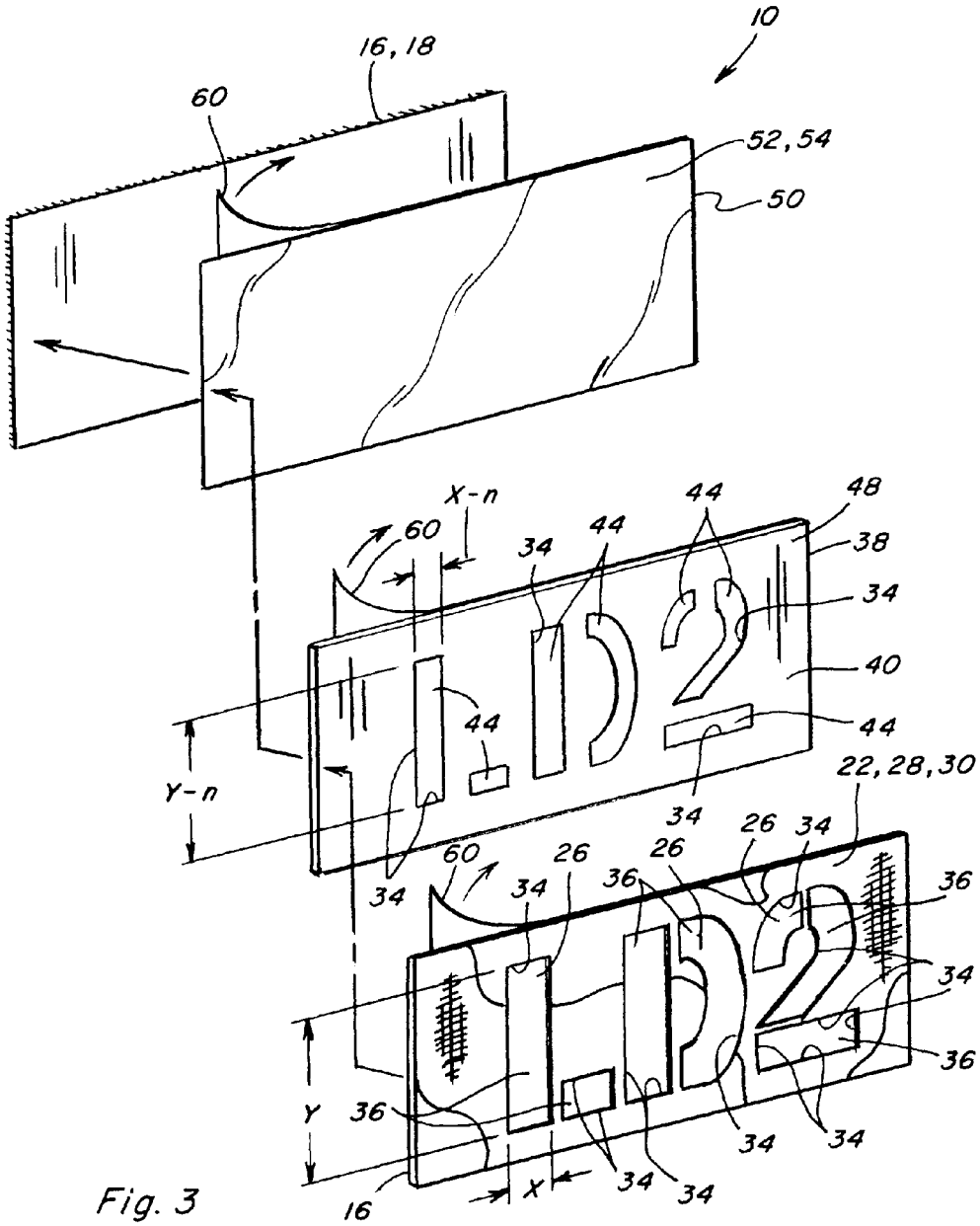
FIG. 3 is a front perspective assembly view of the cell tag of FIGS. 1 and 2, illustrating steps of manufacture thereof.

Cell tag 10 includes a second sheet 38 having a front surface 40 and a back surface 42, and apertures 44 therethrough having the shape of all or a portion of the at least one symbol and/or character of first sheet 28 but of a predetermined second size marginally smaller than the first predetermined size of apertures 36, as denoted by the equations "X−n" and "Y−n" in FIG. 3, the value "n" representing the marginal difference between the respective widths (X dimension) and heights (Y dimension) of the apertures 36 and 44. Second sheet 38 can be of a polymer film material, and/or a woven fabric or the like. Apertures 44 can be produced in any suitable manner, such as by laser cutting or die cutting.

Front surface 40 of second sheet 38 has peripheral edge portions 46 bounding at least a substantial portion of apertures 44 therethrough, and at least peripheral edge portions 46 comprise a commercially available photoluminescence material 48 that will absorb light and glow in low light or dark conditions for several hours thereafter, such as those that meet MIL-3891B. In this regard, it can be observed that the visible peripheral edge portions 46 have a width equal to about one-half the marginal value "n". As a non-limiting example, the photoluminescence material will have a white, ivory or light green appearance under daylight conditions, and will emit a light green glow under low light and dark conditions, sufficient for identification purposes. For convenience of manufacture, the photoluminescence material can comprise a film or layer that covers the entire surface of second sheet 38, if desired, and can be coated with a suitable protective material such as a suitable clear polymer.

Cell tag 10 additionally includes a third sheet 50 which can be of a film and/or fabric material, having a front surface 52 of a thermal reflective material, which is preferably an infrared reflective material, denoted by numeral 54. As a non-limiting example, thermal reflective material 54 can comprise a commercially available material that reflects radiation within the infrared range, which is nominally wavelengths from the edge of visible red light at 0.74 micrometers (μm), and extending conventionally to 300 μm. This material will have a black or dark appearance under daylight conditions, but will glow sufficiently when exposed to infrared radiation under low light or dark ambient light conditions for identification purposes. A non-limiting exemplary suitable material can be those available that meet one or more U.S. military specifications, commercially referred to by the term "glint squares".

Figure 4:
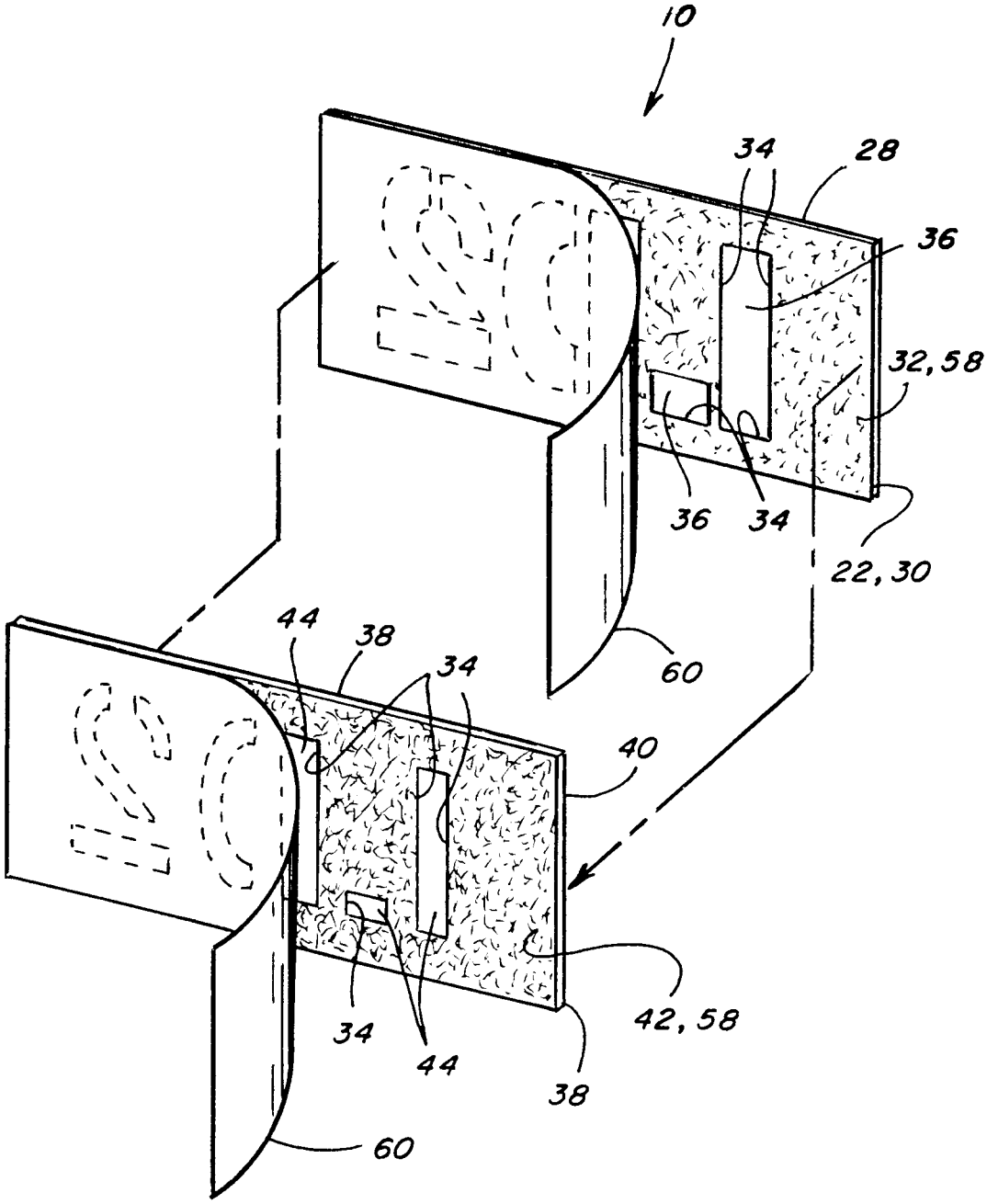
FIG. 4 is a rear perspective assembly view showing elements of the cell tag of FIGS. 1, 2 and 3.
Figure 5:
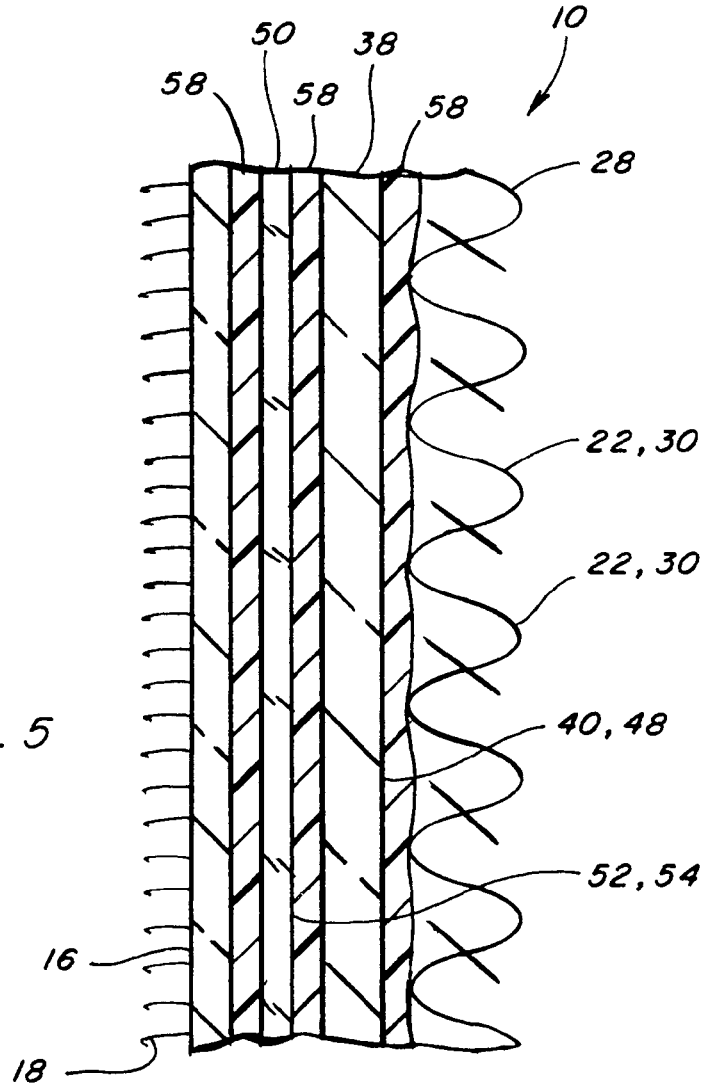
FIG. 5 is a representative sectional view through the cell tag of FIGS. 1-4.

As best shown in FIGS. 3 through 5, the sheets of cell tag 10 are fixedly attached or laminated together. In this regard, at least back surface 32 of first sheet 28 is adhered to front surface 40 of second sheet 38 using only an adhesive or adhesives selected from the group consisting of a contact adhesive, a pressure sensitive adhesive, and a reactive adhesive, closely about at least a substantial portion of peripheral edge portions 46 of the second sheet, such that the peripheral edge portions 34 of the first sheet will bound peripheral edge portions 46 of the second sheet and the peripheral edge portions 46 of the second sheet, and importantly, the photoluminescence material 48 will outline and bound apertures 44 of the second sheet. Most preferably, the entire overlapping abutting portions of sheets 28 and 38 will be adhered together in this manner to provide secure attachment between the sheets and so as to fix the relation of the photoluminescence material in the apertures of the first sheet.

Front surface 52 of third sheet 50 will preferably be adhered in the same manner to back surface 42 of second sheet 38, to securely attach the second and third sheets together, and such that infrared reflective material 54 will be viewable in apertures 44 of the second sheet and bounded and outlined by the photoluminescence material 48. Back surface 16 of cell tag 10 including hooks 18 can comprise a fabric or film suitably attached to the back of third sheet 50 in a suitable manner, such as using the adhesives set forth above for secure attachment over the entire covered surface of the third sheet. Additionally, for security, the three layers of sheets 28, 38, and 50 can be stitched together, as denoted by stitching 56 about the outer periphery of cell tag 10, for strength.

Figure 6:
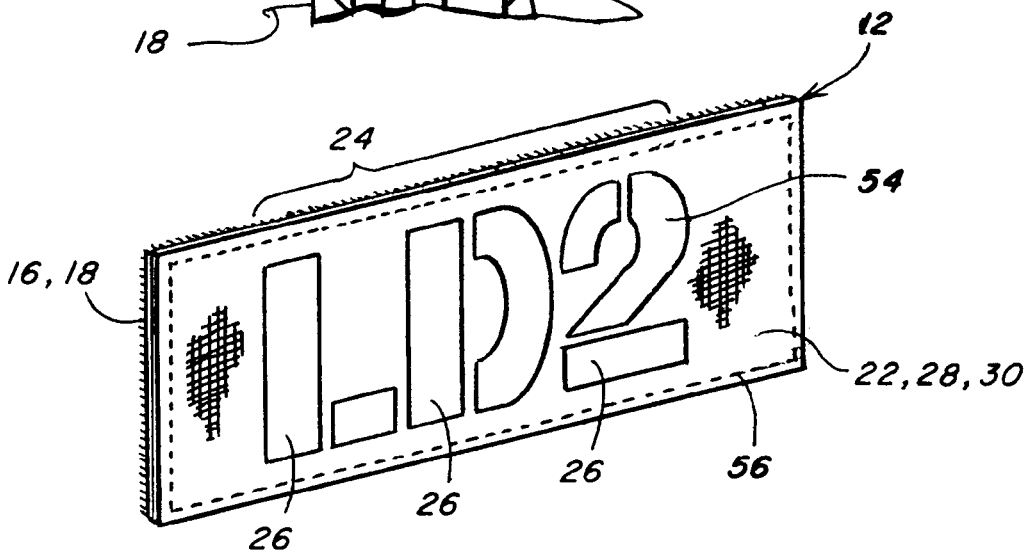
FIG. 6 is a perspective view of another embodiment of a cell tag of the invention.

In FIG. 6 cell tag 12 is shown. Cell tag 12 differs from cell tag 10 in the use of only first sheet 28 with third sheet 50, such that peripheral edge portions 34 of the first sheet bound and define apertures 36 defining call sign 24, and so that infrared reflective material 54 is visible in apertures 36 to allow identification when infrared radiation is present. Cell tag 12 also includes hooks 18 for attachment to pile fabric surface 20 of a garment in the above described manner. Stitching about the outer edge of tag 12 can also be used if desired for strength enhancement. Alternatively, a sheet 38 including photoluminescence material 48 could be used instead of infrared reflective material 54 to provide identification under just low light and darkness conditions.

As an advantage, because stitching is not required about the individual symbols or characters of the call sign, labor is saved, yet adequate strength and durability is achieved, with reduced occurrence of ripping or detachment of adjacent regions of the cell tag and resultant identification problems that can occur.

As a preferred manner of manufacture, the adhesives used for attaching the sheets together comprise a layer 58 of an acrylic based pressure sensitive adhesive, adhered to the back surface 32, 42 of the sheet to be adhered, and covered by a protective film 60 which is removed when used. As a result, temperature activated adhesives is avoided, which can cause possible damage one or both of photoluminescence material 48 and infrared reflective material 54, when activated, which can require application of heat to 300 degrees F. or so for thermosetting adhesives, and 180 degrees F. or so, for non-thermosetting adhesives.

Thus, there has been shown and described a novel method of manufacturing a cell tag, which overcomes many of the problems and shortcomings set forth above. It will be apparent, however, to those familiar in the art, that many changes, variations, modifications, and other uses and applications for the subject device are possible. All such changes, variations, modifications, and other uses and applications that do not depart from the spirit and scope of the invention are deemed to be covered by the invention which is limited only by the claims which follow.

What is claimed is:

1. A method of manufacturing a cell tag, comprising steps of:

providing a first sheet having a front surface and a back surface, and at least one peripheral edge portion defining and bounding an aperture through the first sheet having a shape of at least a portion of a symbol or a character of a predetermined first size and comprising all or a portion of a call sign;

providing a second sheet having a front surface and a back surface, and at least one aperture therethrough having the shape of the symbol or the character of the first sheet and a predetermined second size marginally smaller than the first predetermined size, the front surface of the second sheet having at least one peripheral edge portion bounding at least a substantial portion of the at least one aperture through the second sheet and comprising a photoluminescence material;

providing a third sheet having a front surface of a thermal reflective material;

fixedly attaching the back surface of the first sheet to the front surface of the second sheet using only an adhesive or adhesives selected from the group consisting of a contact adhesive, a pressure sensitive adhesive, and a reactive adhesive, closely about at least a substantial portion of the at least one peripheral edge portion of the second sheet, such that the at least one peripheral edge portion of the first sheet will bound the at least one peripheral edge portion of the second sheet and the at least one peripheral edge portion of the second sheet will outline and bound the at least one aperture of the second sheet; and fixedly attaching the front surface of the third sheet to the back surface of the second sheet, such that the thermal reflective material will be viewable in the at least one aperture of the second sheet and bounded and outlined by the photoluminescence material of the at least one peripheral edge portion of the second sheet.

2. The method of claim 1, wherein the photoluminescence material is susceptible to damage when exposed to temperatures above a predetermined temperature, and at least the step of attaching the front surface of the second sheet to the back surface of the first sheet is performed at a temperature less than the predetermined temperature.

3. The method of claim 1, wherein the third sheet includes a back surface opposite the front surface thereof, comprising hooks or loops of a hook and loop fastening system.

4. The method of claim 1, wherein the thermal reflective material comprises a material that reflects radiation within the infrared range.

5. The method of claim 1, wherein the first sheet comprises a woven nylon fabric material and the aperture is formed therethrough by a laser cutting step.

6. The method of claim 1, wherein the step of fixedly attaching the back surface of the second sheet to the front surface of the third sheet is performed using an adhesive or adhesives selected from the group consisting of a contact adhesive, a pressure sensitive, and a reactive adhesive only.

7. The method of claim 1, wherein the entire front surface of the second sheet comprises the photoluminescence material.

8. The method of claim 1, wherein the symbol or character comprises at least one alphanumerical character.

9. The method of claim 1, wherein the adhesive or adhesives comprise an acrylic based pressure sensitive adhesive.

10. A method of manufacturing a cell tag having a call sign visible under low light and dark conditions, comprising steps of:

providing a first sheet having a front surface, a back surface, and peripheral edge portions defining a plurality of apertures of a predetermined size through the first sheet comprising characters of the call sign;

providing a second sheet having a front surface comprising one of a photoluminescence material and a thermal reflective material; and fixedly attaching the back surface of the first sheet to the front surface of the second sheet using only an adhesive or adhesives selected from a group consisting of a contact adhesive, a pressure sensitive adhesive, and a reactive adhesive, closely about at least a substantial portion of the peripheral edge portions.

11. The method of claim 10, wherein the second sheet comprises peripheral edge portions defining a plurality of apertures therethrough marginally smaller than the size of the apertures through the first sheet and positioned and oriented so as to be visible within the apertures of the first sheet when the back surface of the first sheet is fixedly attached to the front surface of the second sheet; and comprising a step of fixedly attaching a third sheet to a back surface of the second sheet such that a front surface of the third sheet will be visible through the apertures of the second sheet, the front surface of the third sheet comprising another of the photoluminescence material and the thermal reflective material.

12. The method of claim 11, wherein the step of fixedly attaching the third sheet to the back surface of the second sheet is performed using only an adhesive or adhesives selected from the group consisting of a contact adhesive, a pressure sensitive adhesive, and a reactive adhesive, applied closely about at least a substantial portion of the peripheral edge portions of the second sheet.

13. The method of claim 11, wherein the thermal reflective material comprises a material that reflects radiation within the infrared range.

14. The method of claim 10, wherein a back surface of a backmost one of the sheets comprises hooks or loops of a hook and loop fastening system.

15. The method of claim 10, wherein the adhesive or adhesives comprise an acrylic based pressure sensitive adhesive.

16. A method of manufacturing a cell tag having a luminescent and infrared reflective call sign, comprising steps of:

providing a first sheet having a front surface, a back surface, and peripheral edge portions defining a plurality of apertures of a predetermined first size through the first sheet comprising characters of the call sign, the back surface including an acrylic based pressure sensitive adhesive layer thereon;

providing a second sheet having a front surface, a back surface opposite the front surface, and peripheral edge portions comprising a photoluminescence material defining a plurality of apertures of a predetermined second size smaller than the first size through the second sheet and comprising the characters of the call sign, the back surface of the second sheet including an acrylic based pressure sensitive adhesive layer thereon;

providing a third sheet having a front surface including a material thereon reflective of radiation in the infrared range only;

fixedly adhering the back surface of the first sheet to the front surface of the second sheet and the back surface of the second sheet to the front surface of the third sheet, respectively, with the acrylic pressure sensitive adhesives such that the peripheral edge portions of the second sheet are located within the apertures through the first sheet in substantially parallel relation to the peripheral edge portions thereof and the material reflective of radiation in the infrared range only is located within the apertures of the second sheet outlined by the peripheral edge portions of the first and second sheets.

17. The method of claim 16, wherein the third sheet has a back surface comprising hooks or loops of a hook and loop fastening system.

* * * * *